US008359813B2

(12) United States Patent
Bodnar

(10) Patent No.: US 8,359,813 B2
(45) Date of Patent: Jan. 29, 2013

(54) STEEL STUD WITH OPENINGS AND EDGE FORMATIONS AND METHOD

(76) Inventor: Ernest R. Bodnar, Burlington (CA)

( * ) Notice: Subject to any disclaimer, the term of this patent is extended or adjusted under 35 U.S.C. 154(b) by 347 days.

(21) Appl. No.: 12/656,790

(22) Filed: Feb. 17, 2010

(65) Prior Publication Data

US 2010/0229501 A1 Sep. 16, 2010

Related U.S. Application Data

(63) Continuation-in-part of application No. 10/510,351, filed on Oct. 6, 2004, now abandoned.

(51) Int. Cl.
*E04C 3/04* (2006.01)
*B21D 47/00* (2006.01)

(52) U.S. Cl. ..... 52/842; 29/897.31

(58) Field of Classification Search ..... 52/481.1, 52/634, 636, 650.1, 842, 850, 837; 29/897.312, 29/897.31, 897.33, 897.35
See application file for complete search history.

(56) References Cited

U.S. PATENT DOCUMENTS

| | | | | | |
|---|---|---|---|---|---|
| 1,502,873 | A | | 7/1924 | Oberg | |
| 1,656,871 | A | | 1/1928 | Schnitzer | |
| 2,154,944 | A | * | 4/1939 | Kullmer | 52/376 |
| 2,177,277 | A | * | 10/1939 | Burke | 52/634 |
| 4,793,113 | A | * | 12/1988 | Bodnar | 52/481.1 |
| 5,157,883 | A | * | 10/1992 | Meyer | 52/357 |
| 6,481,175 | B2 | * | 11/2002 | Potter et al. | 52/634 |
| 2002/0078645 | A1 | * | 6/2002 | Meyer | 52/289 |

* cited by examiner

*Primary Examiner* — Christine T Cajilig

(57) ABSTRACT

A steel stud construction member for use in supporting structures and having openings and reduced heat transfer characteristics as compared with solid web studs, and having a web defining side edges and an axis, a flange on at least one side edge, openings through said web at spaced intervals thereal-ong, of predetermined size and profile, at least a side portion of said web removed from said opening remaining attached integrally to said web, by bend lines being formed along axes parallel to said web axis.
Also disclosed is a composite member (130) made up of two such members (132) joined together.
Also disclosed is a method of making such a member (10,40, 70,100,130,132).

7 Claims, 10 Drawing Sheets

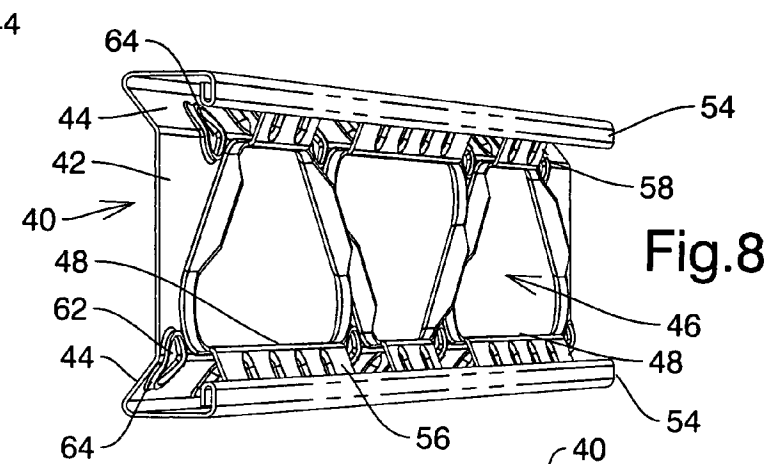
Fig.8
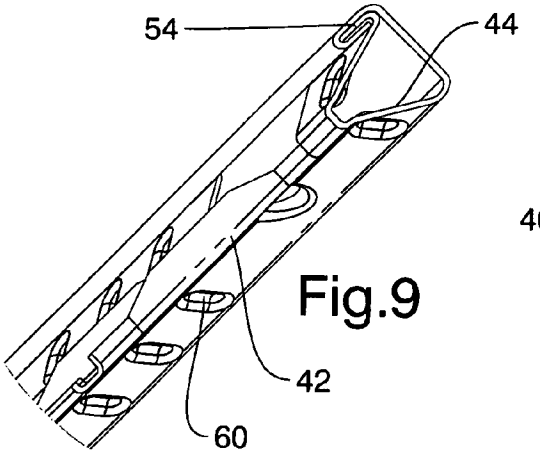
Fig.9
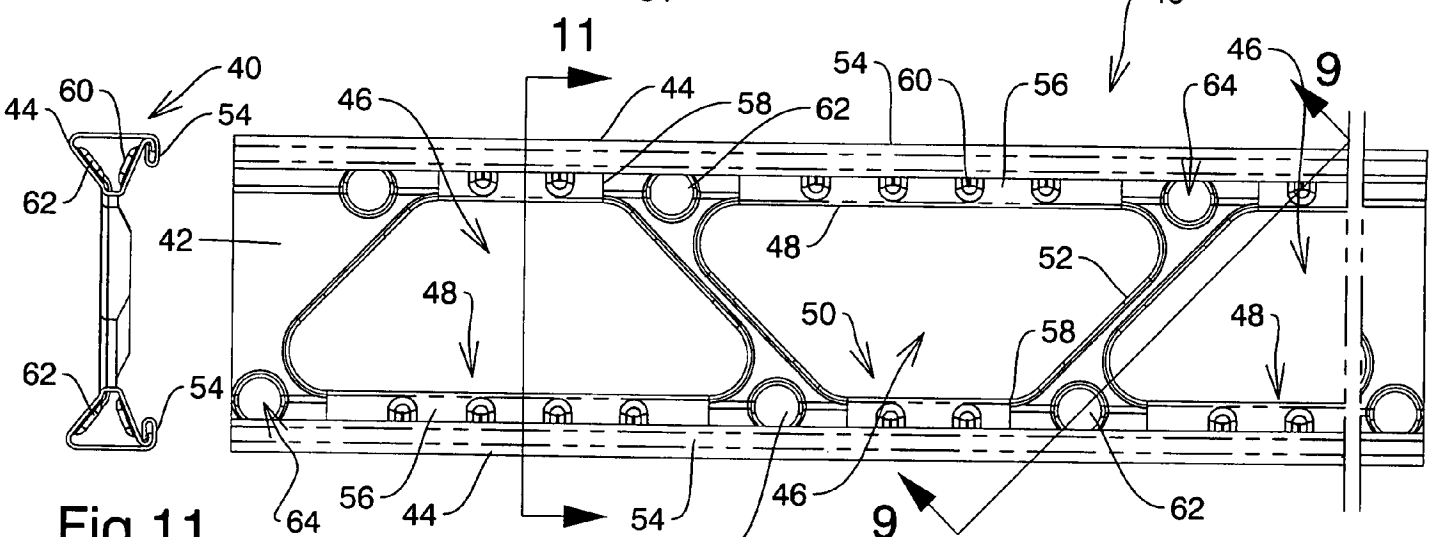
Fig.10
Fig.11

STEEL STUD WITH OPENINGS AND EDGE FORMATIONS AND METHOD

This is a Continuation in Part of USA application Ser. No. 10/510,351, Steel Stud with Openings and Edge Formations and Method, inventor E R Bodnar, filed Oct. 6, 2004 now abandoned.

FIELD OF THE INVENTION

The invention relates to steel studs or structural members formed with openings, and with edge formations formed around the openings. In particular the studs are formed with openings having linear sides and with linear channel formations along at least one linear side of the openings, which are formed with at least two linear bends at respective first and second angles with respect to the plane of the stud, thus forming linear reinforcing channels along the sides of the openings.

BACKGROUND OF THE INVENTION

Steel studs of a wide variety have been proposed for erecting structures.

Usually such studs are used to replace wooden studs. Wood is a relatively poor heat transfer medium. Heat losses through wooden studs has not been a significant problem in the past. Metal studs having solid webs however, do create a heat loss transfer path through the wall or other structure. This results in cold patches along the lines of the studs. Condensation, known as "ghosting" appears along these lines.

Such studs usually were formed as a C-section, i.e. there was a central web, and the opposite side edges of the web were formed into edge flanges. Several such bends were sometime incorporated in an effort to get greater strength, while using thinner gauge metal. However this did not overcome the heat transfer problem. Accordingly metal studs have been proposed with reduced heat transfer properties. These studs were formed with generally triangular or trapezoidal openings, in the web, while the two edges were formed with bends, as before. These openings were positioned so as to define diagonal struts extending across the studs. Heat losses were thus reduced since there was less metal through which the heat could pass. Also the heat transfer path was somewhat extended due to the diagonal placement of the struts. However when these studs are erected, it is usual for the builder to run services through the studs, within the wall. Where the openings in the metal studs are of these specialized generally triangular or trapezoidal shapes, the services, in many cases conduits of substantial diameter, must be able to fit through the openings.

It is not possible to the builder to cut away any of the diagonal struts to provide larger openings for services, since this would drastically reduce the strength of the studs.

The shape of these openings tended to restrict the size of the conduits which could be passed through the studs.

Another problem arose in that the triangular openings were formed with edge flanges around their perimeter. Where these edge flanges extended around an angular corner of the opening there was a tendency for the sheet metal to crack.

Consequently the corners had to be radiussed or rounded out. This meant that there was more metal at each of the corners, than was desirable for heat transfer, and thermal losses could occur.

Another problem arose in cutting these studs to length. The openings were arranged in pairs with one triangle facing one way and the next facing the opposite way. Cutting such studs to length requires that all of the openings of a particular orientation, in all of the adjacent studs in a wall frame, shall line up.

This required to facilitate passing of services through the studs. However due to the alternating orientation of the openings, this requirement resulted in cutting off end portions of studs equal in length to the space occupied by two of the stud openings, in many cases.

Concrete panels are also in wide use for attachment to the exterior of structures to provide for a wide variety of functional and aesthetic effects. Concrete panels are usually of relatively heavy thick material of great weight. Great costs are involved in both materials, labor transportation, and erection of such heavy panels. Attachment of such massive panels to the exterior of a structure also presents serious problems. Proposals have been made for using panels of reduced thickness. Such panels are reinforced by a framework of metal studs.

Usually the metal studs are partially embedded in the concrete. They provide great strength to the panels, and also facilitate erection and attachment of the panels to the structure. Usually the inside surfaces of the resulting walls are covered in with wall sheeting, typically plaster wallboard. The sheeting is often attached directly to the metal studs. The space between the concrete panels and the inner sheeting is usually insulated with suitable batts or the like. However it is known that the metal studs provide a heat transfer path which conducts heat from the building interior to the concrete panels on the exterior, and there are thus substantial heat losses through the panels due to such metal studs.

Accordingly it has been proposed to use the studs with openings described above, with reduced heat transfer properties.

It has now been surprisingly found that the use of the specialized triangular or trapezoidal shapes of these stud openings, is unnecessary.

Heat transfer reduction is possible, by the use of the invention, using openings having linear sides and with linear channel formations along at least one linear side of the openings. These linear channel formations are formed with at least two linear bends at respective first and second angles with respect to the plane of the stud, thus forming linear reinforcing channels along the sides of the openings.

A portion of the opening may be defined by a semi-circular radius. The remainder of the opening can be defined by an extended linear edge. In other embodiments the openings can be shaped with four sides, as a quadrilateral.

This means that the size of the conduit passed through the openings can be increased. The openings substantially span the distance across the web, between the edge flanges of the stud. By the use of the invention it is now possible to form openings which can accept conduits having a diameter almost equal to the distance across the web, between the edge flanges of the stud.

This is a great improvement over the earlier triangular opening configuration.

Previously this was not thought to be possible since openings with radiussed corners were thought to leave excessive metal in the stud which would cause heat transfer losses. Similar advantages can also be obtained in studs having openings of a quadrilateral shape. In both of these studs the openings are larger, and the struts running diagonally between the openings are at a greater angle, and being spaced further apart, than in studs previously known.

It has been found that by the use of relatively small additional depressions and depression openings, near each end of the diagonal struts, the actual heat transfer path can be so reduced, at critical points in the stud, so as to substantially improve on the heat transfer reduction achieved by the use of the specialized triangular or trapezoidal openings and diagonal struts of earlier studs, while at the same time increasing the strength of the stud.

Semi-arcuate openings avoid the problems caused by the corners of the triangular or trapezoidal openings and splitting of metal, and results in a much stronger stud. The use of semi-arcuate openings greatly facilitates high speed manufacture of such studs, since cutting to length becomes less critical, and there is less stud length lost in the process. The use of such openings having linear sides and with linear channel formations along at least one linear side of the openings, which are formed with at least two linear bends at respective first and second angles with respect to the plane of the stud, thus forming linear reinforcing channels along the sides of the openings, provides much increaseed strength.

The same is linear channels are also used in studs having larger quadrilateral shaped openings. This leads to further economies.

In both of these embodiments of studs the openings define service pathways for cylindrical service conduits. In each stud the conduit diameter can be almost equivalent to the distance across the stud between one side edge of the opening and the other, transversely across the stud. This means that the conduits can pass through any opening in the stud, regardless of the orientation of the opening in the stud. This greatly reduces wastage of sheet metal during manufacture.

Much larger conduits can be accepted.

Another factor in earlier designs was the thought that it was essential to remove as much metal as possible, in order to reduce heat transfer problems.

It has now been found that this was incorrect. What is required is to leave a heat transfer path which is longer than a simple transverse line directly across the stud, and which has metal removed at selected locations so as to limit heat transfer.

It has also now been found that the linear edge of each web opening can be greatly strengthened by having web openings with linear sides and with linear channel formations along at least one linear side of the openings, which channels are formed with at least two linear bends at respective first and second angles with respect to the plane of the stud, thus forming linear reinforcing channels along the sides of the openings.

This results in removing less sheet metal at each opening, rather than more This surprising development results in leaving an additional piece of sheet metal along side the linear edge. This additional piece can then be formed, in accordance with another aspect of the invention, into two generally angular bends, resulting in an additional linear channel structures within the stud. This greatly increases the strength of the stud in the critical area of the extended linear edge. The fact that more metal remains in the stud does not increase the heat transfer problems. The extra metal is in a location alongside the web opening and in this location heat cannot be passed across the stud, due to the web opening.

The blanks of sheet metal removed in this process, may be of smaller size than was the case in the blanks of metal removed for previous triangular stud openings, notwithstanding that the web openings themselves are larger. This leads to economies in the process since the blanks are smaller. Slug ejection problems in the manufacturing machinery are reduced and there is less wastage of metal.

The semi-arcuate, or quadrilateral openings reduce the problems for the builder who wishes to pass service conduits through the studs within the wall. Much larger diameter pipes can now be fed through the studs, than was possible before. This leads to less sales resistance due to a greater acceptance of the product in the market place.

These features can be used in studs having edge formations for embedment in concrete.

The features can also be used in forming much heavier duty studs with the edge formations formed into a triangular tube shape.

Even stronger heavy duty studs can be formed by severing a single strip of sheet metal along a zig-zag parting line, so as to form two separate strips of sheet metal. These two strips can be formed with formations described above and can then be joined together into a single composite structural member.

One such a composite fabrication system is disclosed in U.S. Pat. No. 5,207,045, inventor E R Bodnar, and in U.S. Pat. No. 5,592,848, inventor E R Bodnar.

However the composite members shown in those patents were difficult to fabricate, and their design shows what now appears to be structural weaknesses at critical points, which would have reduced their load bearing capacity. Such members were never in fact made, or used.

It will be appreciated that a stud which improves on all these problems associated with prior studs, will have application in general use, for many various construction applications. In particular however it will have advantages in the reinforcement of thin-shell concrete panels.

BRIEF SUMMARY OF THE INVENTION

With a view to achieving the foregoing and other objectives the invention comprises a steel stud construction member having spaced web openings for reduced heat transfer characteristics as compared with solid web studs, and having a web defining a web plane, web side edges and a longitudinal web axis; a flange along at least one web side edge, web openings through said web at spaced intervals therealong, of predetermined size and profile, at least one linear side being defined by each said web opening, said linear side paralleling said longitudinal axis of said web, at least one linear channel portion of each said web along said linear side of said web opening being displaced from said web opening and remaining attached integrally to said web, a first bend formed in said linear channel portion along said web axis and out of the plane of said web, a second bend formed in said linear channel portion parallel to and spaced from said first bend, thereby forming said linear channel portion into a reinforcing channel, struts extending across said web between said openings and defining two strut ends, depressions formed in said web at spaced intervals, at opposite strut ends of said struts, and, depression openings formed in said depressions to reduce heat transfer across said web.

The invention further seeks to provide a steel stud construction member as described wherein said openings are of a shape defining a linear side edge, and an arcuate side edge, said side portion of said web being integral with said linear side edge.

The invention further seeks to provide a steel stud construction member as described wherein said openings have a first longer linear side, and a second shorter linear side opposite to a parallel to one another.

The invention further seeks to provide a steel stud construction member as described wherein said flanges are formed at an angle to said web and including a planar wall extending from said flanges normal to said web, and lips formed along said bracing walls, bent to form a channel shape.

The invention further seeks to provide a steel stud construction member as described including side portions integrally formed of portions of said web removed from said openings, and bent outwardly towards said lips of said bracing walls, an edge of said side portions being captured in said lips whereby to form generally triangular shaped tubes.

The invention further seeks to provide a steel stud construction member as described wherein side portions are removed from the opening but remain integrally attached to said web, said side portions, on one side of said web being angled at an angle to said web diverging from said flanges, and an embedment lip formed along said side portions for embedment in a concrete panel.

The invention further seeks to provide a steel stud construction member as described wherein said flanges are formed at an angle to said web and including a planar wall extending from said flanges normal to said web, and a bracing wall extending integrally from said planar wall.

The invention further seeks to provide a steel stud construction member as described including side portions formed by portions of sheet metal removed from said openings and remaining attached integrally to said web, said side portions being interengaged with said bracing walls, to define a generally triangular shaped tube extending along each side of said member.

The invention also provides a steel stud construction member for use in supporting structures and having reduced heat transfer characteristics as compared with solid web studs, and having, a web defining a linear side edge and a zig zag side edge, and an axis, a flange on said linear side edge, openings through said web at spaced intervals therealong, of predetermined size and profile, at least a side portion of said web removed from said opening remaining attached integrally to said web;

a first bend formed in said side portion, a second bend formed in said side portion spaced from said first bend, said first and second bends being formed along axes parallel to said web axis.

The invention also provides a composite member formed of two steel stud construction members as described being attached to one another to form a composite member.

The invention also provides a method of making steel stud construction member having a web and side edges, and a flange along at least one said side edge, and openings through said web, said method comprising the steps of, forming said openings in said web at spaced intervals therealong, with one side of said opening being linear and leaving a side portion of metal attached to said one linear side of said web, forming said side portion along said at least one linear side edge of said web, and, forming said side portion out of the plane of said web by bending said side portion along a first bend line, and then along a second bend line spaced from said first bend line thereby forming a linear reinforcing channel.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

FIG. 8 is a perspective of a further embodiment of steel stud construction member illustrating another embodiment of the invention, in which the openings are of generally quadrilateral shape;

FIG. 9 is a perspective of a portion of FIG. 8 from another angle;

FIG. 10 is a side elevation of the stud of FIG. 8;

FIG. 11 is a section along line 11-11 of FIG. 10

DESCRIPTION OF A SPECIFIC EMBODIMENT

As already described the invention provides sheet metal steel stud construction members, having reduced thermal conductivity, suitable for use in erecting various structures, walls, floors, roofs, and the like. The invention also provides sheet metal steel stud construction members suitable for use in reinforcement of thin-shell concrete panels which are widely used in completing walls, in particular. Such thin-shell structures can also form floors, roofs and the like.

The invention also provides composite steel stud construction members formed by joining two stud portions together, and a method of making such a composite member.

Figure 1:
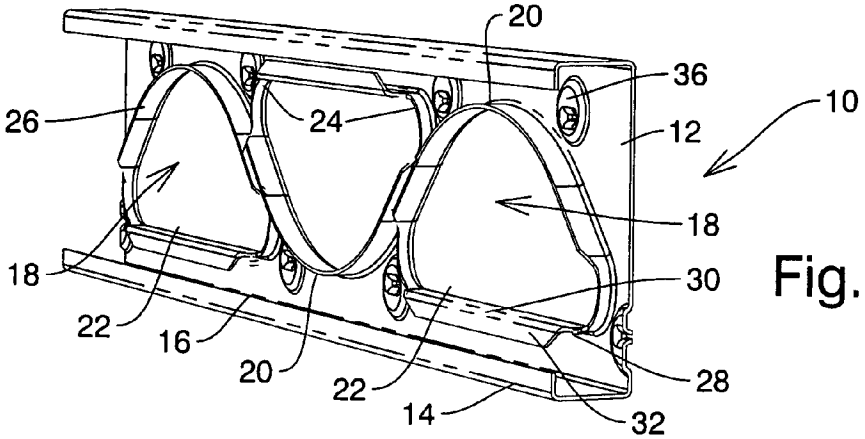
FIG. 1 is a perspective illustration of a steel stud construction member illustrating one embodiment of the invention, in which the openings have one side edge which is semi-circular.
Figure 2:
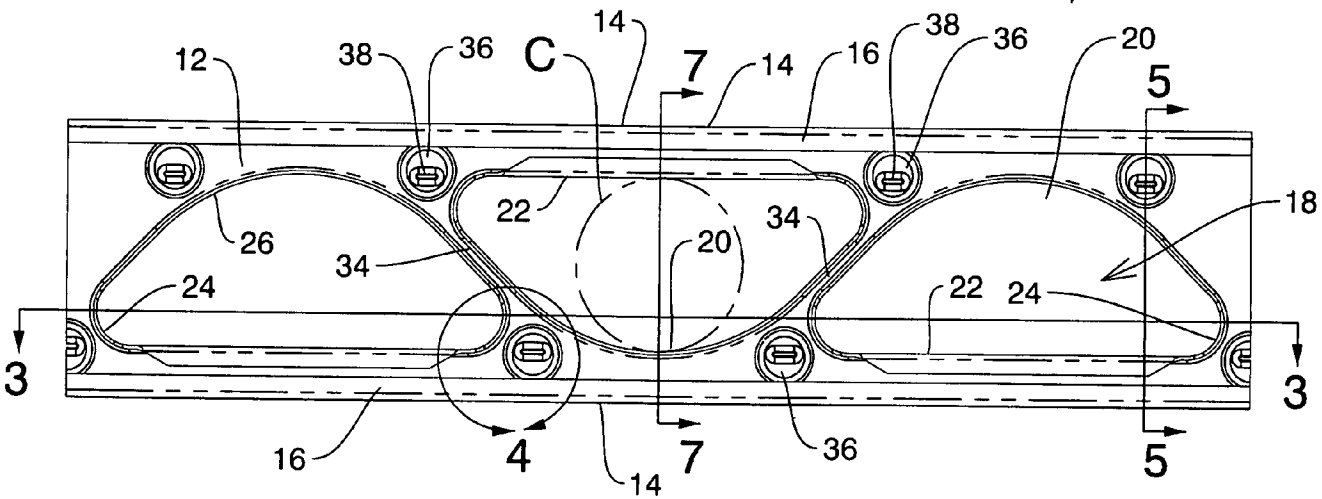
FIG. 2 is a side elevation of the stud of FIG. 1.
Figure 3:
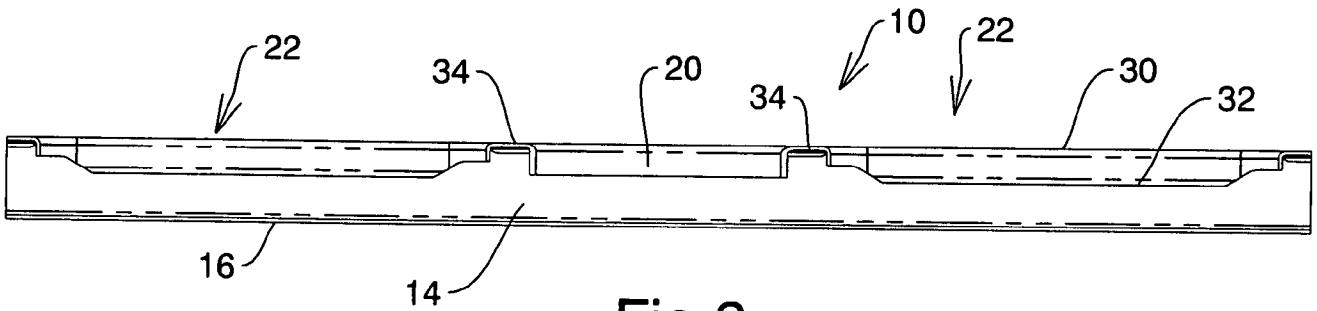
FIG. 3 is a section along line 3-3 of FIG. 2.
Figure 7:
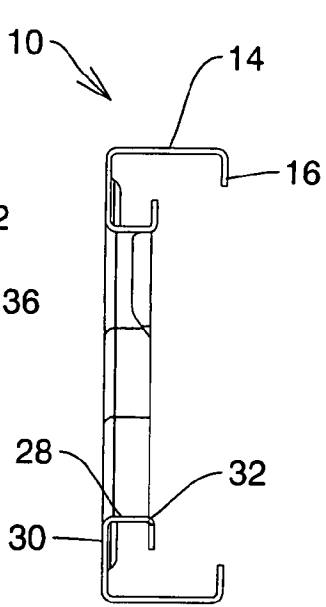
FIG. 7 is a section along line 7-7 of FIG. 2.
Figure 6:
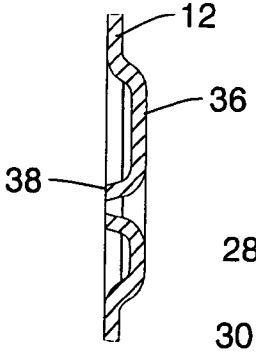
FIG. 6 is a section along line 6-6 of FIG. 4.

Referring to FIG. 1 it will be seen that the invention is there illustrated in the form of a steel stud construction member (10), formed of sheet metal, in this case steel. The stud (10) has a web (12) which is essentially planar, and edge flanges (14) along each side edge of the web (12). Each of the flanges is formed by bending the web at right angles. Lips (16) are formed on each edge flange ( ) again at right angles.

In the web (12) web openings (18) are formed by punching out a portion of the sheet metal.

In this embodiment the web openings (18) are formed with a semi-circular or arcuate profile on one side as at (20). On the opposite side the openings (18) are formed with an elongated linear profile side as at (22). Between the arcuate profile (20) and the linear profile (22) there are shorter linear junctions. Between the linear profile and the junctions there are radiussed corners as at (24). Extending all around web opening (18) there is an edge rim flange (26) formed at right angles to the web (12). Along the linear side of the web opening (18) there is a reinforcing channel (28) formed. Reinforcing channel (28) is formed by a portion of the web (12) which is has been partly punched out but which remains joined to the web along the linear side of the web opening (18).

Reinforcing channel (28) is formed by a first right angle bend (30) (FIG. 5) formed in said linear channel portion along said web axis and displacing a first part of said linear channel portion at right angles to said web, and a second right angle bend (32) formed in said linear channel portion parallel to and spaced from said first bend, thereby displacing a second part of said linear channel portion at right angles to said first part and thereby shaping said web, said first part and said second part into a generally U-shaped reinforcing channel.

In this way reinforcing U-shaped channel (28) forms a linear U-shaped channel shape, extending along the linear side of the opening (18). In this way reinforcing channel (28) greatly reinforces the stud (10) along the length of the linear side of web opening (18)

This feature permits the web openings (18) to be formed with relatively large dimensions, so that a conduit, shown in phantom as C, can extend through web opening (18) and is limited only by the transverse dimension of the opening transversely across the web (12). This is a great improvement over studs having triangular openings. In such triangular openings conduit size is severely restricted, by the geometry of the opening, or in the alternative was capable of accepting only flexible round air handling ducts.

It will be noted that the shape and placement of the web openings (18) defines struts (34) extending diagonally across the web (12). Such struts are longer than the struts defined in studs having triangular openings. Since heat, by conduction, can pass only along such struts, the actual heat loss due to the struts is less than in a comparable stud with triangular opening.

Studs (10) are further formed with depressions (36) at opposite ends of each strut (34) where the strut flares out into the web (12). Centered across depression (36) there are punched out depression openings, in this case slots (38). The slots (38) provide an effective barrier to conduction of heat across the stud at the end of each strut, and improve its thermal efficiency. Heat, by conduction, will have to travel along a winding path before reaching the edge of the stud at the outside wall (not shown).

FIGS. 8 to 11 illustrate another embodiment of stud (40). This stud has some features which are common to stud (10) of FIG. 1. Thus it has a web (42) and edge flanges (44).

However the edge flanges (44) are bent out of the plane of the web by about 45 degrees for reasons to be described. The angle can vary somewhat for various applications.

In this case the stud (40) has web openings (46) which are of generally quadrilateral shape.

Web openings (46) have a long linear side (48) and a short linear side (50) parallel to one another. Two diagonal sides extend between long side (48) and short side (50). Where two adjacent diagonal sides meet the long side (48) there are radiussed corners.

Where the two adjacent diagonal sides meet the short side (50) there are angular corners. The diagonal sides of two adjacent web openings (46) define between them struts (52), which extend from one side to the other of the web (42), along diagonal paths.

The stud (40) could be formed with lips on the edge flanges as in FIG. 1.

However in this case the stud is intended for a heavier duty application. The edge flanges (44) are thus formed with extended clamp channel lips (54).

The metal of the web (42) punched out from the web opening (46) is not completely severed in this case. Bracing plates (56) and (58) extend as integral portions of web (42) along longer side (48) and along shorter side (50) of the web opening. Plates (56) and (58) are folded back at substantially 45 degrees, an angle which will be equal and opposite to the angle of edge flange (44). The free edges of bracing plates (56) and (58) are turned over and interfitted in channels (54) of flanges (44), thus forming a series of discontinuous lengths of tube of generally triangular configuration in section, extending along the axis of each side of the strut (40).

This embodiment of stud is particularly advantageous. It combines the great strength of the triangular tubes on both edges of the stud, and also the retention of the greatest amount of metal removed by blanking the web openings. The largest part of such metal is retained and is folded over outwardly to form bracing walls forming one side of the tube.

The bracing plates (56) and (58) are formed with a series of indentations (60) for greater strength.

In order to reduce heat transfer, a series of depressions (62) are formed in edge flanges (44) adjacent each end of each strut (52), and depression openings or slots (64) are formed in the depressions, as in FIG. 1.

Many features of the studs of FIG. 1 and or 5, are also adaptable to forming a stud for use in reinforcing thin shell concrete panel construction.

Figure 12:
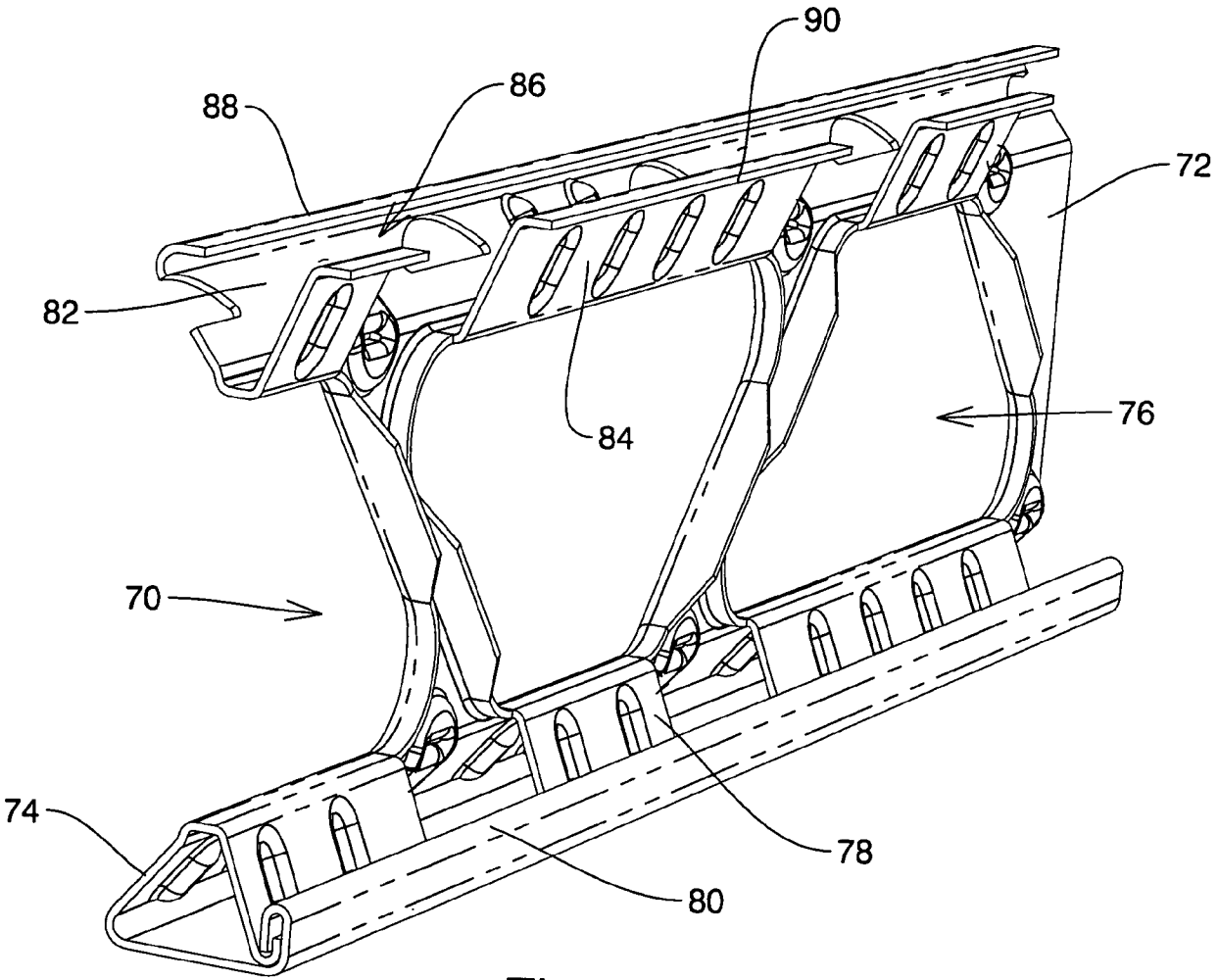
FIG. 12 is a perspective of a further embodiment of stud for use in reinforcing concrete panels.
Figure 13:
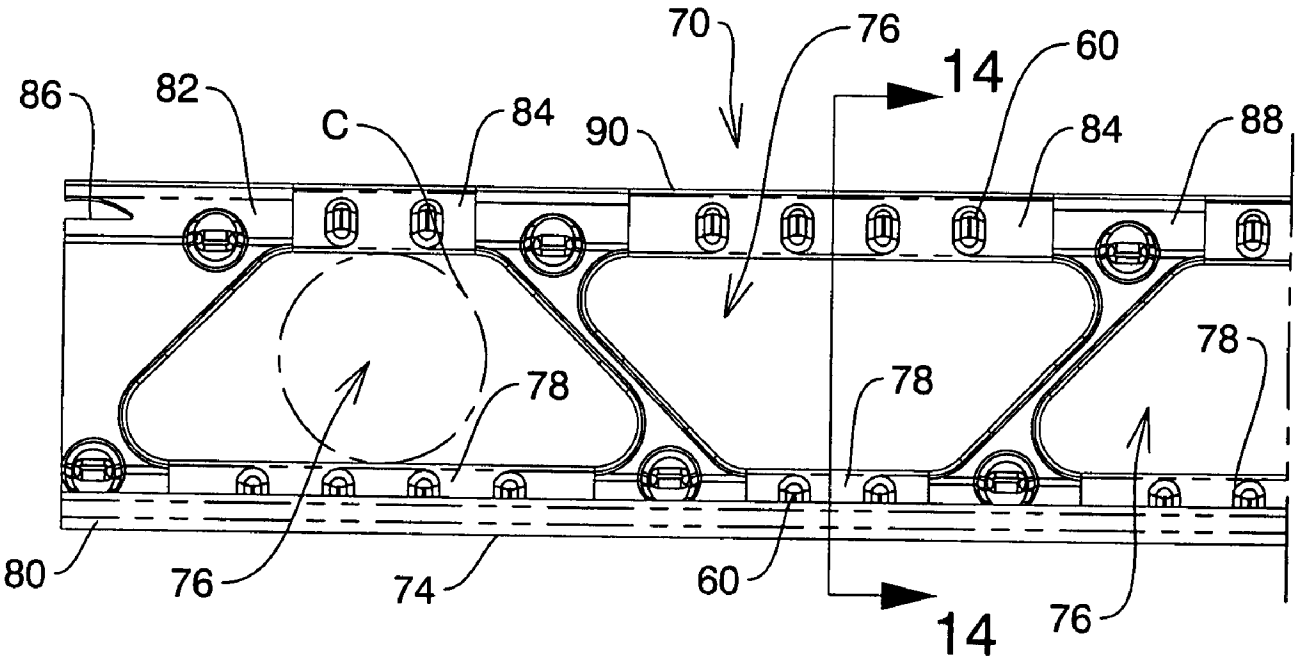
FIG. 13 is a side elevation of the stud of FIG. 12.

Such a stud (70) is shown in FIGS. 12, 13, and,14.

Figure 5:
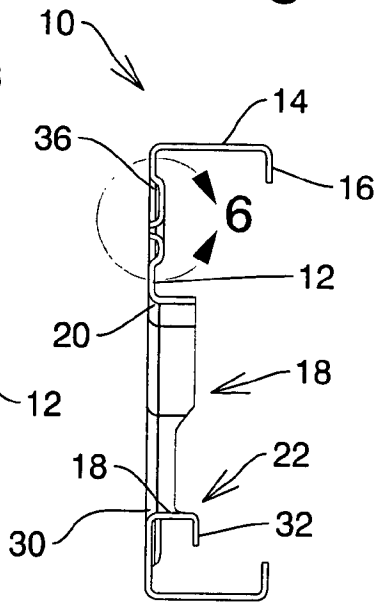
FIG. 5 is a section along line 5-5 of FIG. 2.
Figure 4:
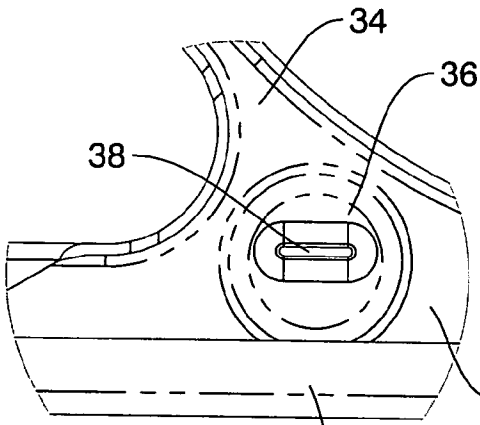
FIG. 4 is a view of a detail of FIG. 2 shown at circle 4.

Stud (70) has a web (72), and angled edge flanges (74) as in FIG. 5. Stud (70) has openings (76) of quadrilateral shape as in FIG. 5.

Along one side of web (72) there are a series of bracing plates (78) as in FIG. 5.

These bracing plates (78) are bent at an angle. Free edges of plates (78) are captured in channel (80) formed on the edge flanges (74), thus forming a series on lengths of tube. Both the edge flanges and the bracing plates are formed with linear indentations for greater strength.

On the opposite side edge of the web (72) there are modified edge flanges (82), and modified bracing plates (84). Flanges (82) are bent outwardly, and are formed with a series of openings or ports (86) for concrete flow.

A return lip (88) is formed along flange (82) for embedment in concrete.

Bracing plates (84) being formed by integral portions of web (72) struck out of openings (76) are folded back at an angle to complement flanges (82) and are discontinuous. Embedment lips (90) are formed on plates (84) for embedment in concrete.

Thus this embodiment provides a stud of great strength providing reinforcement for a concrete panel. The flanges (82) and the plates (84) being partially embedded in concrete but being spaced laterally apart in the panel will provide maximum security of adhesion between the studs and the concrete.

This stud enables the use of a reduction in thickness of sheet metal. It is anticipated that a reduction of at least one gauge and probably two gauges can be achieved while still providing adequate support to a concrete panel.

This will reduce the cost of the panels. It will also reduce the heat transfer through the panel and stud, since the reduction in gauge reduces the actual mass of metal available to provide a heat transfer path.

Figure 15:
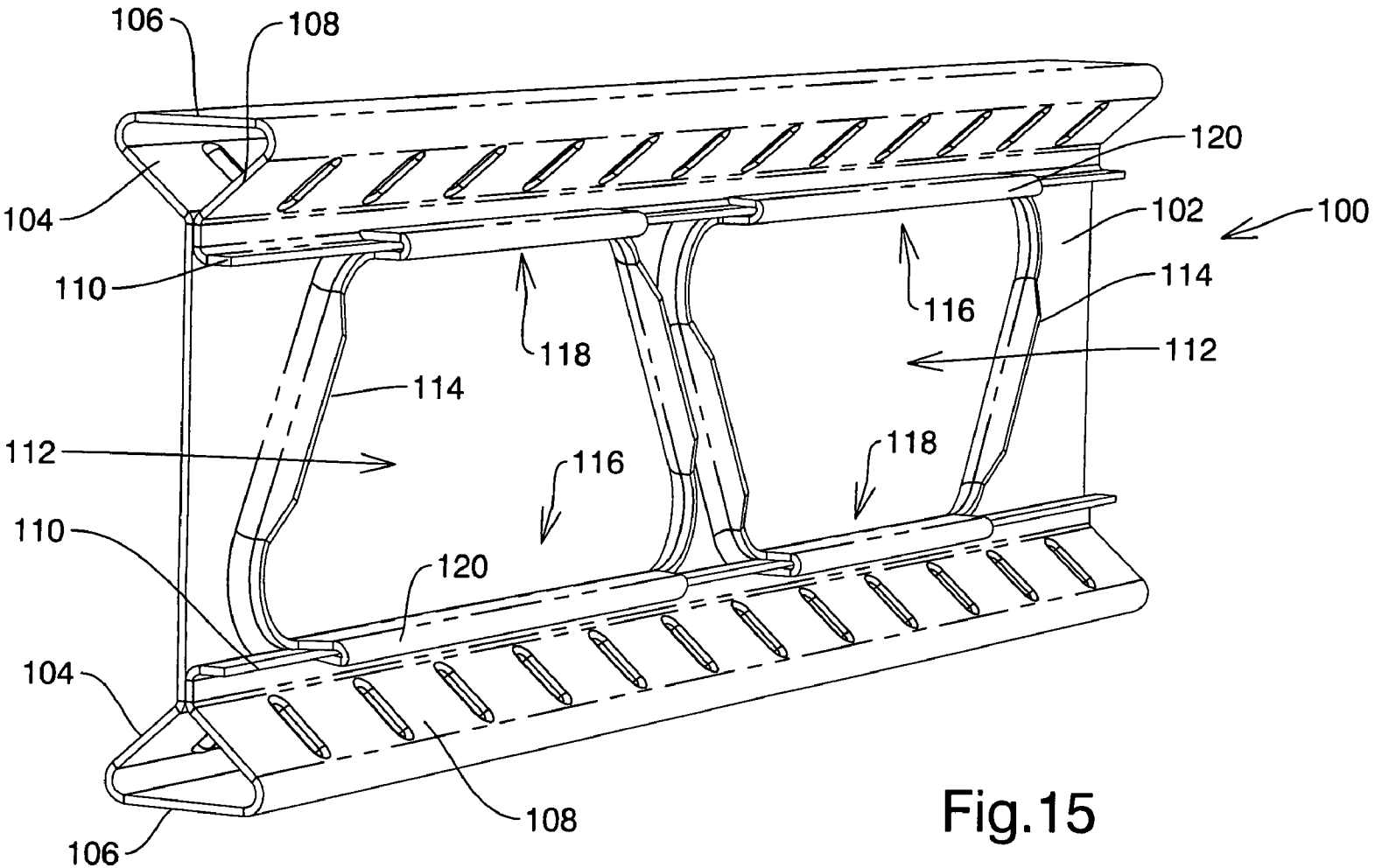
FIG. 15 is a perspective of a steel stud construction member having some features similar to FIG. 1 and some features similar to FIG. 8.
Figure 16:
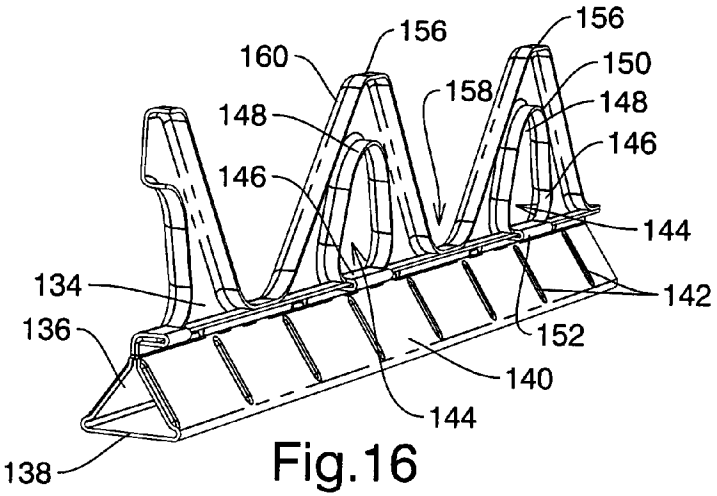
FIG. 16 is a perspective of a further embodiment of steel stud construction member for use in making a composite member.
Figure 17:
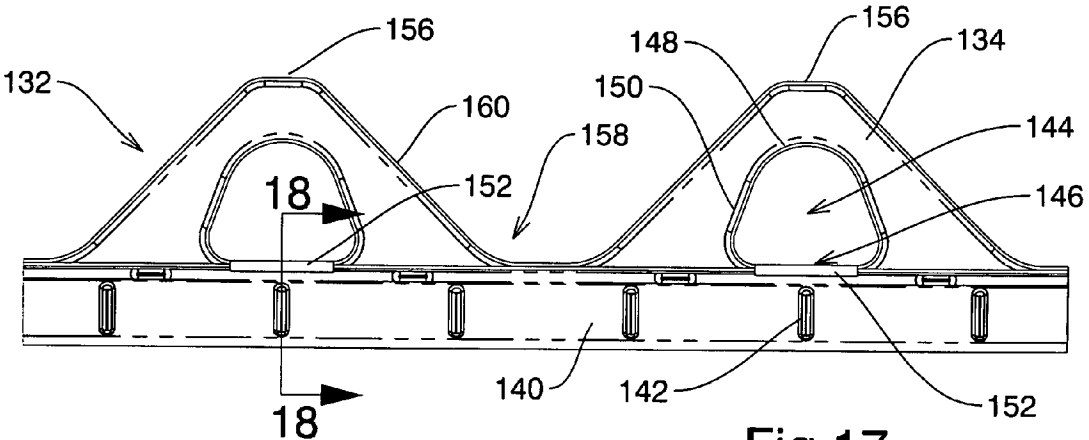
FIG. 17 is a side elevation of the steel stud construction member of FIG. 16.
Figure 18:
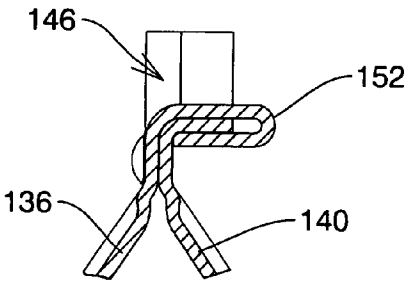
FIG. 18 is an enlarged section along line 18-18 of FIG. 17.

FIG. 15 shows a further form of stud (100) having features still further increasing its strength, or, conversely, permitting the use of a thinner gauge material and still achieving the same or better strength as compared with earlier studs.

Stud (100) has a web (102) and identical edge flanges (104) along either side of the web. Flanges (104) are bent at an angle to the plane of the web. Integral planar walls (106) extend from flanges (104) normal to the plane of the web.

Bracing walls (108) extend integrally from walls (106) and are bent inwardly complementary to the angle of flanges (104). Walls (106) terminate in angled lips (110) which contact and lie against the web (102). Lips (110) are bent into an L-shape and extend normal to the plane of the web (102). Web openings (112) are formed through web (102) as before, being of quadrilateral shape as in the FIG. 8 embodiment, and having edge rims or flanges (114) formed therearound as before. Linear side edges (116) and (118) of web openings (112) are defined by flaps (120) of sheet metal, extending integrally from flanges (114) for purposes to be described, thus retaining more of the metal removed by the web opening (112) and employing it to improve the stud, rather than discarding it as waste.

Flaps (120) are folded back on themselves to capture adjacent lips (110) on walls (108). Thus each side of the stud is formed with a continuous triangular tube for great strength, and the free edge of each tube is captured and held, at intervals, by integral flaps struck out from the web openings. More metal is retained in the stud, which both increases its strength, or in the alternative permits a reduction in gauge, without in any way increasing the heat losses through the stud. Ridges are formed in flanges (104) and walls (108) for greater strength. Depressions, and slotted depression openings (not shown) may be formed in the web, as described above to further reduce heat losses. This form of stud may have even greater strength than the FIG. 5 stud in certain circumstances. However it will be seen that it does require the use of a wider web initially. The bracing walls are formed integrally with the edge flanges and planar walls. This means that it will require a wider strip to start with to have sufficient metal to form these walls.

Conversely this embodiment retains somewhat less of the metal blanked out from the opening, and is therefor somewhat more wasteful.

A further embodiment of stud is shown in FIGS. 16 17, 18, and 19.

This is a composite member (130) made up of two studs (132) which are formed separately from one another, and are then joined together (FIG. 19) to provide the composite member (130) of great strength and light weight.

In this embodiment two studs (132) are formed each having identical components.

The two studs may be formed by parting a single strip of sheet metal, or two studs can simply be formed as a single strip having a straight edge and a zig-zag edge, and then cut into two identical lengths.

Each stud (132) has a web (134). One side edge of the web is straight. It has a continuous edge flange (136) bent at an angle to web (134) as in FIG. 10.

A planar tube wall (138) extends from flange (136). The free edge of wall (138) is turned back at an angle complementary to flange 136( ) to provide a ridged wall (140). The flange (136) wall (138) and wall (140) together form a triangular cross-section tube axially along one side of the web which greatly reinforces the stud.

Ridges (142) are formed in flange (136) and in wall (140) for greater strength. Web (134) is formed with web openings (144) which have base linear side (146) and an arcuate side (148) opposite to side (146). Edge rims or flanges (150) are formed around openings (144)

Some metal alongside base edge (146) is left intact and is folded over to form fold channels (152) to capture the free edge of wall (140) at intervals. Between folds (152) there are depressions (154) formed in web (134) and in wall (140) to assist in restricting movement.

The side edge of web (134) opposite to flange (136) is formed along a zig-zag path defining peaks (156) and valleys (158). Along the zig-zag edge there is an edge flange (160) formed continuously.

Figure 19:
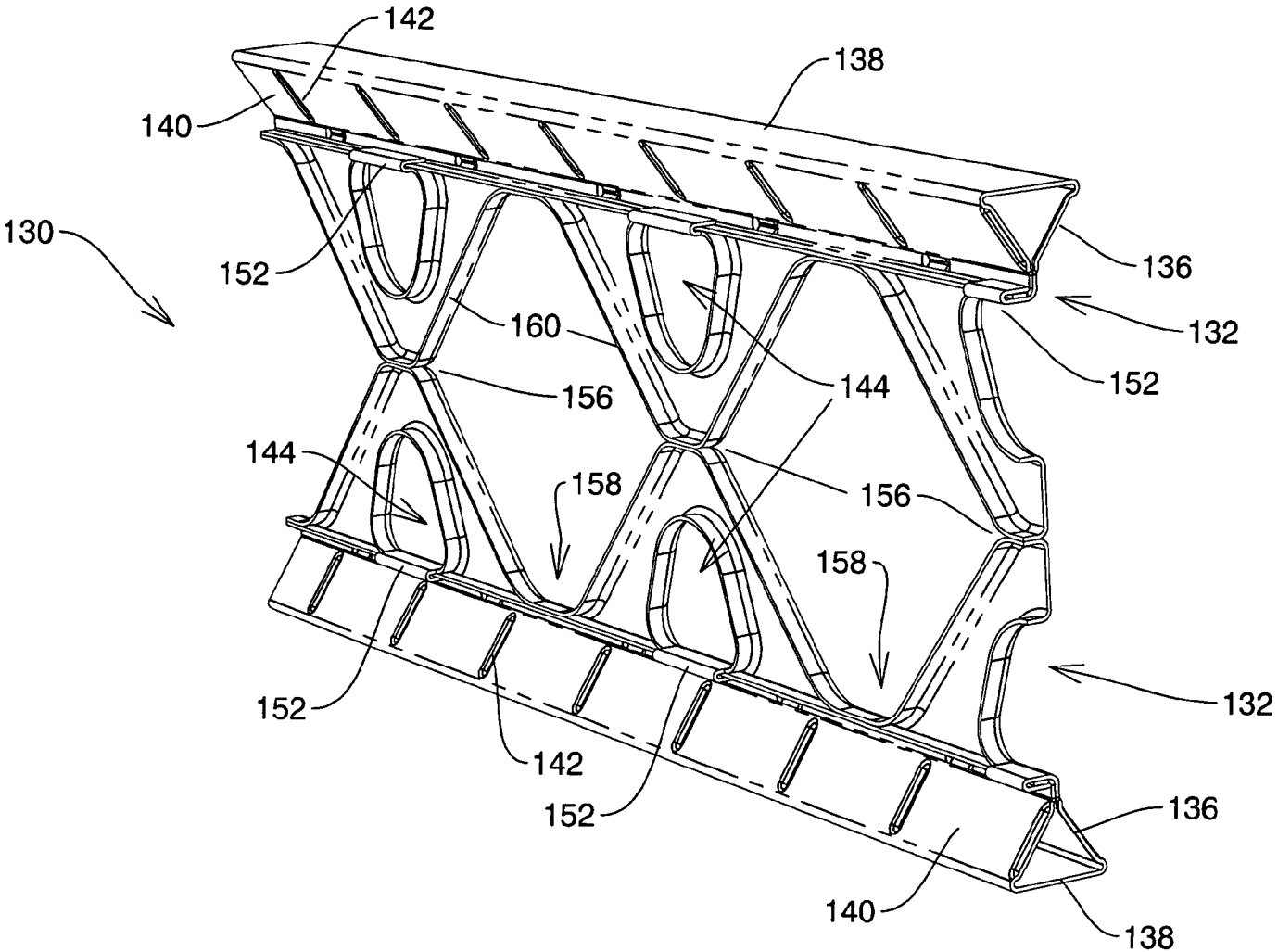
FIG. 19 is a perspective of a composite steel stud construction member formed of two of the FIG. 16 studs joined together.

In use two such studs (132) are juxtaposed as shown in FIG. 19 with their peaks (156) touching, and their valleys defining large, generally hexagonal openings through the member. Large diameter conduits can thus be passed through the member as desired. Peaks (156) are secured to each other as by welding or the like to form a composite member.

Manufacture of the studs (10) of FIG. 1 can proceed by first forming the openings (18) and rim flanges (26) in a suitable press. This can be a flying die press, but it is advantageous to use a rotary press of the type which has two rotary die support rolls, and dies on the support rolls, in which the two support rolls rotate bringing the dies together and apart as the sheet metal moves between them.

After blanking and forming of the openings and forming of the edge flanges around the openings, and the forming of the depressions (36) and punching of the slots (38) where used, the semi-formed sheet metal is then passed through a series of roller die stands, such as are known per se and require no description.

The roller dies on the die stands will progressively form the edge flanges (14) and the axial bends (30) and (32) in the flanges (14) on either side of the openings.

In FIG. 8, and in FIG. 13 and in FIG. 15, where the lips are to be turned over to capture the plates, this too is performed in a series of roller dies through which the sheet metal passes at high speed, and is formed and bent along the axis of the sheet metal in an efficient and economical manner.

Cutting to length will normally be performed upstream of the rotary press where the strip sheet is still flat and unformed. In this way each piece of sheet metal passing through the various punching and forming and roll forming sequences is already precut to the exact length required for the finished stud.

It also possible to cut to length downstream of the roller dies, although this may be difficult to control.

It must be remembered that in cutting to length, provision must be left at each end of each stud to leave end portions of the stud free of openings, so that in can be stood in place in an eventual structure, with all of the openings in each stud aligned with one another across the structure. This will greatly facilitate the installation of services through the openings.

Suitable controls which form no part of the invention are incorporated in the rotary press so that the rotary press is timed to operate exactly where required on each stud. Where openings and forming are not required, at each end of each stud, the controls disable the rotary press so that leading and trailing ends of the sheet metal pass through unpunched and unformed.

In the case of the FIG. 19 embodiment after forming the two studs (132), their peaks (156) are secured together as by welding or any other suitable fastening, to form the composite member (130).

Figure 21:
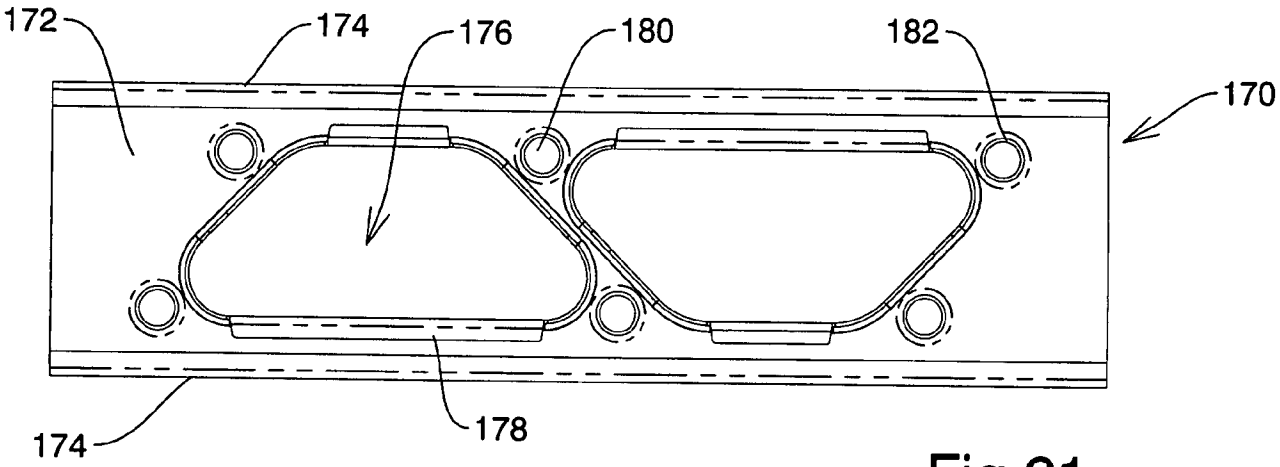
FIG. 21 is a side elevation of the embodiment of FIG. 20.
Figure 20:
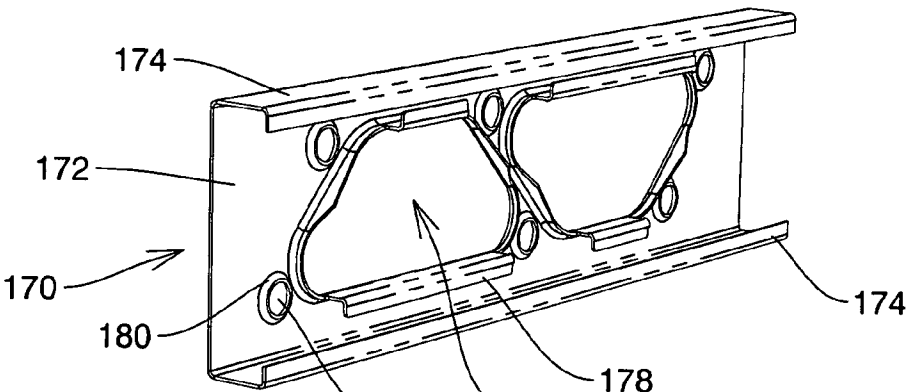
FIG. 20 is a perspective of a further embodiment employing depressions with round holes through them.

FIGS. 20 and 21 show a further embodiment. In this case stud (170) Is similar to the studs of FIG. 1 having a web (172) and flanges (174).

Openings (176) through web (172) are of generally quadrilateral shape, similar to the openings (46) of FIG. 10. Channels (178) are formed as in FIG. 1.

Depressions (180) with central round holes (182) are formed in web (172) located in the same place as depressions (36) of FIG. 1. The round holes are found to restrict heat transfer through the web. By forming the round holes as depressions they are formed with edge flanges as shown and they thus add to the strength of the stud.

This feature of round holes and edge flanges can be used in place of the depressions shown in the other figs, including (36) or (62) or (154).

Figure 22:
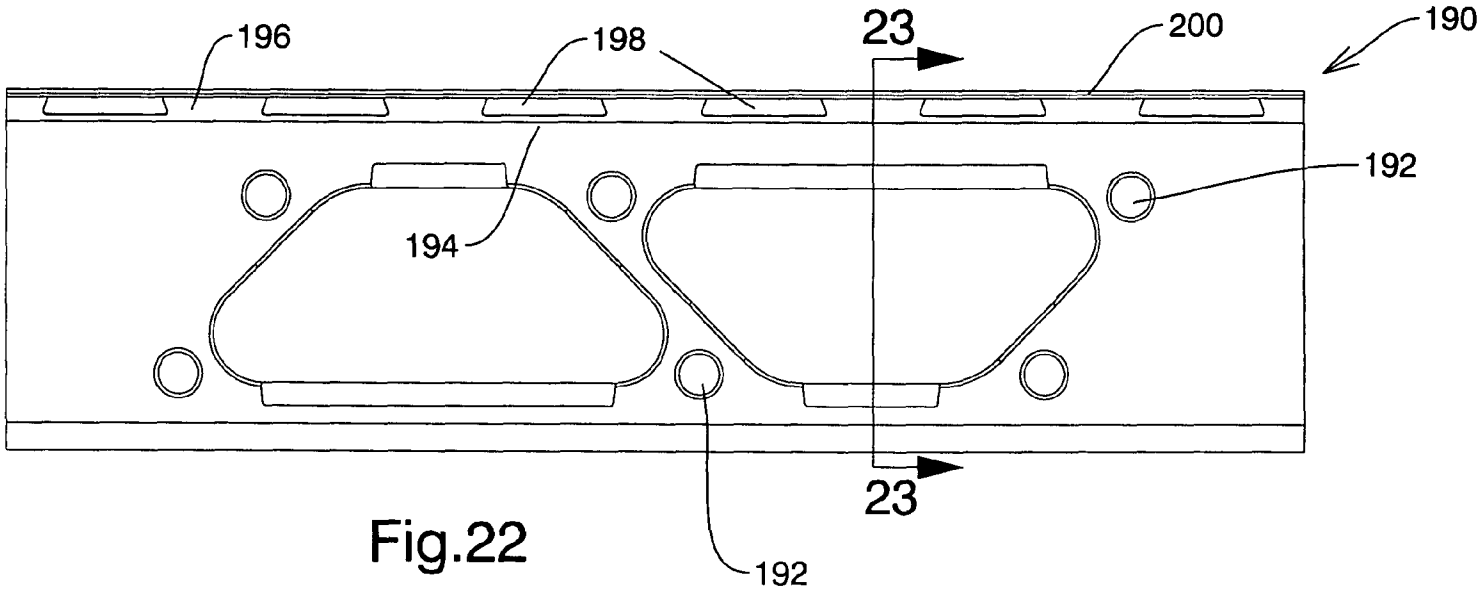
FIG. 22 is a side elevation of a steel stud construction member for embedment in a concrete panel, and, FIG. 23 is an end elevation of the steel stud construction member of FIG. 22.
Figure 23:
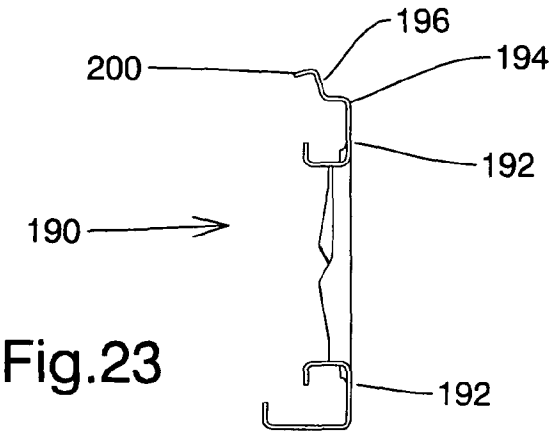

FIGS. 22 and 23 show a stud for embedment in a concrete panel.

The stud (190) is similar in most respects to the stud of FIG. 1, and has most of the same features. The stud (190) may have semi radiussed main openings as in FIG. 1 or may have trapezoidal main openings as in FIGS. 10 and 20.

The stud (190) has round holes (192) as in the embodiment of FIGS. 20 and 21.

In this case however one edge flange (194) is bent outwardly to form angled flange (196). Angled flange (196) is formed with slot like openings (198) for flow of concrete therethrough. A locking strip (200) is bent over along the free edge of angled flange (196).

This form of angled flange for embedment in concrete can be adapted to either the FIG. 1 stud or the FIG. 10 stud or other variations of either. The foregoing is a description of a preferred embodiment of the invention which is given here by way of example only. The invention is not to be taken as limited to any of the specific features as described, but comprehends all such variations thereof as come within the scope of the appended claims.

PARTS LIST 1120C106

Figure 14:
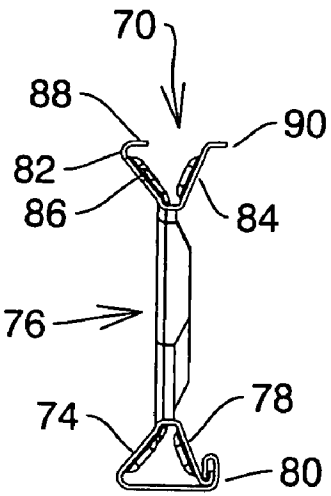
FIG. 14 is a section of the stud of FIG. 13

| | |
|---|---|
| 10 | Stud |
| 12 | web |
| 14 | edge flages |
| 16 | lips |
| 18 | openings |
| 20 | arcuate side |
| 22 | linear side |
| 24 | corners |
| 26 | rim flange |
| 28 | bracing lip |
| 30 | right angle |
| 32 | right angle |
| 34 | struts |
| 36 | depression |
| 38 | slot |
| 40 | stud FIG. 8-11 |
| 42 | web |
| 44 | edge flange |
| 46 | openings |
| 48 | linear side long |
| 50 | linear side short |
| 52 | struts |
| 54 | channel lips |
| 56 | bracing plate |
| 58 | bracing plate |
| 60 | indentations |
| 62 | depressions |
| 64 | slots |
| 66 | — |
| 68 | — |
| 70 | stud FIG. 12-14 |
| 72 | web |
| 74 | edge flange |
| 76 | openings |
| 78 | bracing plates |
| 80 | channel |
| 82 | edge flange |
| 84 | bracing plate |
| 86 | openings |

-continued

PARTS LIST 1120C106

| | |
|---|---|
| 88 | return lip |
| 90 | embedment lip |
| 92 | — |
| 94 | — |
| 96 | — |
| 98 | — |
| 100 | stud FIG. 15 |
| 102 | web |
| 104 | edge flange |
| 106 | planar wall |
| 108 | bracing lip |
| 110 | angled lips |
| 112 | openings |
| 114 | edge flange |
| 116 | linear side |
| 118 | linear side |
| 120 | flaps |
| 122 | — |
| 124 | — |
| 126 | — |
| 128 | — |
| 130 | Composite member |
| 132 | studs |
| 134 | web |
| 136 | edge flange |
| 138 | planar tube wall |
| 140 | ridged wall |
| 142 | ridges |
| 144 | opening |
| 146 | linear side |
| 148 | arcuate side |
| 150 | edge flange |
| 152 | fold channels |
| 154 | depressions |
| 156 | peaks |
| 158 | valleys |
| 160 | edge flange |
| 162 | — |
| 164 | — |
| 166 | — |
| 168 | — |
| 170 | stud |
| 172 | web |
| 174 | flange |
| 176 | opening |
| 178 | channel |
| 180 | depression |
| 182 | round hole |
| 184 | edge flange |
| 186 | |
| 188 | |
| 190 | stud |
| 192 | round holes |
| 194 | flange |
| 196 | angled flange |
| 198 | openings |
| 200 | locking strip |

What is claimed is:

1. A steel stud construction member having spaced web openings for reduced heat transfer characteristics as compared with solid web studs, and comprising;

a web defining a web plane, web side edges and a longitudinal web axis;

a flange along at least one web side edge;

web openings through said web at spaced intervals therealong, of predetermined size and profile;

at least one side of each web opening being defined by a linear side paralleling said longitudinal axis of said web;

wherein said web openings are arranged in an alternating orientation;

diagonal struts between adjacent said web openings; extending across said stud member from one web side edge to the other said web side edge and define strut ends;

at least one linear channel portion of each said web along said linear side of said web opening being displaced from said web opening and remaining attached integrally to said web;

a first bend formed in said linear channel portion along said web axis and out of the plane of said web;

a second bend formed in said linear channel portion parallel to and spaced from said first bend, thereby forming said linear channel portion into a reinforcing channel;

strut end depressions formed in each said web edge at opposite strut ends of each of said struts;

and, depression openings formed in said strut end depressions to reduce heat transfer across said stud.

2. A steel stud construction member as claimed in claim 1, wherein said linear channel portion, is formed with said first and second bends at right angles and defines a rectangular channel shape extending along an axis parallel to said web axis.

3. A steel stud construction member as claimed in claim 1 wherein said web openings are of a shape defining an arcuate side edge, said linear channel portion of said web being integral with said linear side edge.

4. A steel stud construction member as claimed in claim 1 wherein there are two said flanges one along each side of said web being formed normal to said web, and lips formed along said flanges, normal to said flanges.

5. A steel stud construction member as claimed in claim 1 wherein said depression openings formed in said depressions in said web at opposite ends of each said strut are in the form of slots to restrict heat transfer through said stud member.

6. A steel stud construction member as claimed in claim 1 wherein there are two said flanges along respective sides of said web, and wherein one said flange is formed with an outurned embedment lip for embedment in a concrete slab.

7. A method of making a steel stud construction member having a web defining a web plane, a web axis and web side edges, and a flange along at least one said web side edge, and web openings through said web, said method comprising the steps of;

forming said web openings in said web at spaced intervals therealong, said openings defining at least one linear side parallel to said web axis, and leaving a channel portion of metal attached to said web along one linear side of each said web opening;

forming struts extending across said web from one web side edge to the other web side edge between said web openings forming depressions in respective said web side edges adjacent each end of each strut;

forming depression openings in said depressions, forming said edge flange along said at least one side edge of said web, forming a first bend in said channel portion out of the plane of said web; and, forming a second bend in said channel portion, said second bend being parallel to and spaced from said first bend whereby to form a reinforcing channel along said linear side of said web opening, by bending said side portion along bend lines parallel to the web axis.

* * * * *